United States Patent [19]

Aubel et al.

[11] 3,982,555

[45] Sept. 28, 1976

[54] VACUUM RELAY VALVE

[75] Inventors: John A. Aubel; Ronald E. Reinke, both of Decatur, Ill.

[73] Assignee: Borg-Warner Corporation, Chicago, Ill.

[22] Filed: July 14, 1975

[21] Appl. No.: 595,907

[52] U.S. Cl. ..... 137/103; 123/117 A

[51] Int. Cl.[2] ..... F02P 5/10

[58] Field of Search ..... 137/102, 103; 123/117 A

[56] References Cited

UNITED STATES PATENTS

| | | | |
|---|---|---|---|
| 2,650,581 | 9/1953 | Short et al. | 123/117 A |
| 3,712,279 | 1/1973 | Vartanian | 123/117 A |
| 3,797,512 | 3/1974 | Martin | 123/117 A |
| 3,828,743 | 8/1974 | Ludwig | 123/117 A |

*Primary Examiner*—Robert G. Nilson
*Attorney, Agent, or Firm*—Herman E. Smith

[57] ABSTRACT

A vacuum relay valve for isolating a vacuum operated dependent device from a contaminated vacuum signal source includes a check valve and an atmospheric bleed valve arranged such that a negative-going pressure change in the vacuum source causes the check valve to open and the bleed valve to close, permitting evacuation of the vacuum operated device by flow toward the source, while a positive-going pressure change in the vacuum source causes the check valve to close and the bleed valve to open thereby isolating the vacuum operated device from the signal source and permitting the pressure in the device to rise by infusion of atmospheric air. The relay valve may include a timing restriction arranged for isolation from the signal source, which is purged by unidirectional flow each time the device is evacuated.

3 Claims, 3 Drawing Figures

VACUUM RELAY VALVE

BACKGROUND OF THE INVENTION

Field.

The present invention relates to improvements in vacuum relay valves by which a changing vacuum level is sensed and relayed to a dependent device which is controlled in accordance with the vacuum level. For example, a vacuum level in the air induction system of an internal combustion engine is sensed and used to operate a dependent device such as the distributor spark advance or an emission control device.

Prior Art

The prior art includes numerous examples of valves associated with a vacuum line for regulating a vacuum signal transmitted to a dependent device. For example, a check valve and restriction may be employed in the spark advance system of an engine such that a positive-going pressure change at the carburetor spark port is applied immediately to the distributor but a negative-going pressure change is delayed. Other examples of prior art valves may respond to a condition such as temperature for modifying the valve operation.

In general, the prior art valves are arranged in such a way that a negative-going pressure change in the carburetor spark port results in flow from the dependent device while a positive-going pressure change at the spark port carries a mixture of air and fuel toward the dependent device. As a result, the dependent device, connecting lines and regulating valves become charged with a mixture of fuel and air which flows back and forth through the components of they system as the vacuum level at the source undergoes changes. The fuel portion of the air fuel mixture separates from the air and condenses in the system. The lighter fractions of the fuel tend to boil off when the system is subjected to vacuum, leaving gummy deposits which may interfere with the motion of moving parts or may block or change the value of a flow restriction.

The present invention seeks to overcome the above-mentioned problem in that a portion of the system is charged with air during positive-going vacuum excursions, which air is then used for purging the system by flow toward the vacuum source during a subsequent negative-going pressure excursion.

SUMMARY OF THE INVENTION

The present invention relates to a vacuum control system protected against contamination from a vacuum signal source and more particularly to a vacuum relay valve construction providing such protection for a system with which it is used.

A principal object of the present invention is to provide means for protecting a vacuum control system from contaminants which may be present in the vacuum source to which the system is connected. This advantage is achieved by providing for infusion of air into portions of the system while the source signal approaches atmospheric pressure and for purging portions of the system with the entrapped air when the source signal departs from atmospheric pressure. The preferred means for achieving the above advantage is a vacuum relay valve adapted for connection between a vacuum signal source and a vacuum operated dependent device, which responds to a rise in signal pressure by admitting atmospheric air to the dependent device and which responds to a decrease in signal pressure by permitting flow from the dependent device toward the vacuum signal source. Other control elements may be incorporated in the relay valve, and may be arranged for isolation from the signal source.

DESCRIPTION OF THE PREFERRED EMBODIMENT

Figures 1, 2, 3:
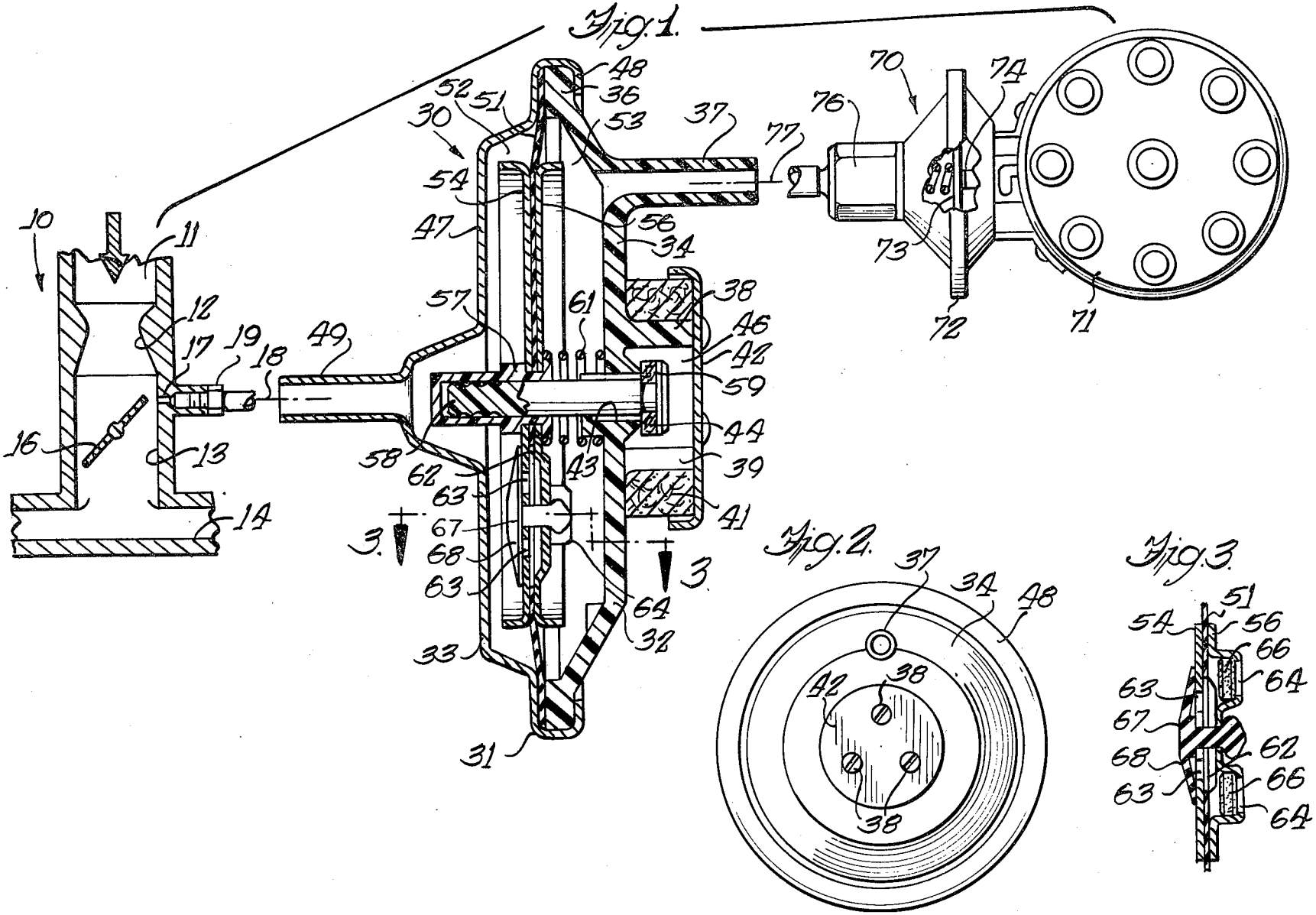
FIG. 1 is a fragmentary view of a vacuum control system showing a section through a vacuum relay valve.
FIG. 2 is an end view of the relay valve shown in FIG. 1.
FIG. 3 is a fragmentary section view taken along the line 3—3 of FIG. 1.

Referring now to the drawing, FIG. 1 shows schematically a vacuum control system including a vacuum signal source 10, a vacuum relay valve 30, and a vacuum operated dependent device 70. For purposes of illustrating an operative embodiment of the invention, the vacuum signal source is shown schematically as a portion of an air induction system of an internal combustion engine, and the vacuum operated dependent device is shown as the spark advance control associated with a distributor for the engine. The relay valve 30 is shown to enlarged scale in order to show the construction thereof more clearly. It is to be understood that the vacuum relay valve can be connected to various sources of vacuum signal and to various kinds of vacuum operated dependent devices. For example, the relay valve may be used for controlling an exhaust gas recirculation valve in accordance with changing pressure conditions in the intake system of an engine.

The vacuum signal source 10 is illustrated fragmentarily as including an air passage 11, a venturi portion 12, an air/frame mixture passage 13, and an inlet manifold 14. In practice, the air passage 11, venturi portion 12 and mixture passage 13 may be incorporated in a carburetor along with a movable throttle plate 16 and a spark port 17. The spark port 17 and throttle plate 16 are so positioned with respect to each other that the pressure exhibited in the spark port is regulated in part by the position of the throttle plate. For example, when the throttle plate is closed, the spark port is exposed to atmospheric pressure present in inlet 11, but when the throttle plate is open the port is exposed to the subatmospheric pressure or vacuum present in manifold 14. Intermediate positions of the throttle plate result in intermediate pressure levels in the spark port. It is thought that a more detailed description of the spark port and throttle plate is unnecessary since this cooperation is well known in internal combustion engine practice.

The vacuum operated dependent device 70 is illustrated as a spark advance control, the construction and operation of which is well known in the art. Typically a distributor 71 is provided with a vacuum motor 72 which includes a diaphragm 73 and linkage 74 effective to advance or retard the spark timing in accordance with the degree of vacuum or subatmospheric pressure imposed on the diaphragm. In view of the great extent to which such devices are in use with internal combustion engines, it is thought that a more detailed explanation is unnecessary.

The relay valve 30 transmits a pressure to diaphragm 73 which is related to the pressure existing in spark port 17. Relay valve 30 includes a shell-like body 31 including a pair of body members 32, 33. Body member 32 includes a wall portion 34 which terminates in an annular flange portion 36. An outlet port 37 extends through wall portion 34 and is adapted for connection to a fitting 76 communicating with distributor diaphragm 73. Such connection can be made for example by means of a tube indicated by the broken line 77.

Wall portion 34 includes pedestal portions 38 defining apertures 39 therebetween. A filter device 41 surrounds the pedestals 38 and apertures 39 and is held in place by a cap 42. Wall portion 34 also includes a passage 43 and a bleed valve seat 44 communicating with atmospheric bleed chamber 46.

Body member 33 includes a wall portion 47 which is suitably shaped to provide an annular rim 48 and an inlet port 49. The inlet port 49 is adapted for connection to spark port 17 as by means of a tube indicated by broken line 18 and fitting 19.

A flexible diaphragm 51 extends across the interior of body 31 defining an inlet chamber 52 and an outlet chamber 53. An outer margin of diaphragm 51 is secured between annular flange 36 and a corresponding portion of wall 47 to form an air tight joint.

A pair of backing plates 54, 56 are secured to a mid portion of diaphragm 51 by means of a central fitting 57. Fitting 57 is secured to bleed valve stem 58 which carries bleed valve head 59. Fitting 57 is engaged by a biasing spring 61 for normally maintaining the diaphragm and backing plates in a position for seating bleed valve head 59 against bleed valve seat 44.

An opening 62 in diaphragm 51 communicates with apertures 63, 63 in backing plate 54 and with apertures 64, 64 in backing plate 56. An optional feature of construction, shown in FIG. 3, includes porous plugs 66 which may be inserted between apertures 63, 64 to provide a time delay flow restriction.

A resilient umbrella type check valve 67 is secured to the backing plate having a resilient cap portion 68 disposed in inlet chamber 52 arranged to cover the apertures 63, 63.

It is believed that the foregoing description adequately covers the structural features of relay valve 30, and attention will now be directed to the operation thereof in connection with a vacuum control system.

OPERATION

For the purpose of describing pressure changes in the system the term "negative-going" is used to indicate a pressure change which is dropping further below atmospheric pressure and the term "positive-going" is used to indicate a pressure change which is rising toward atmospheric pressure. The terms "vacuum" or "sub atmospheric" indicates a pressure below atmospheric pressure. In some instances the term "ambient" may be employed to indicate atmospheric pressure or a source of air at atmospheric pressure.

With respect to the vacuum signal source, it should be recalled that an inlet manifold 14 of an internal combustion engine ordinarily includes a charge mixture of air and fuel and may include other substances such as additives or recirculated exhaust gas. When the throttle plate 16 is nearly closed, as at idle speed, the manifold pressure drops below atmospheric pressure creating a strong vacuum. As the throttle plate is moved toward open, the inrushing air raises the pressure toward atmospheric pressure resulting in a weaker vacuum. A somewhat opposite pressure migration occurs in the throat of the venturi which responds to rate of flow of air. Thus when the throttle plate is closed or nearly closed, there is little or no flow through the venturi and as a result the pressure above the throttle plate remains at or near atmospheric pressure. On the other hand, when the throttle plate is open, the inrushing air flowing through the venturi lowers the pressure creating a stronger vacuum. This phenomenon is used for metering fuel in proportion to air flow, the fuel being ordinarily introduced near the throat of the venturi. In view of such pressure migrations, the location of the port 17 is chosen for compatibility with the function of the dependent device. As a result, an engine may be provided with numerous vacuum ports such as 17 at different locations for controlling various kinds of dependent devices. In the drawing the dependent device is illustrated as a spark advance mechanism and the vacuum port 17 is located in the position of a "spark port". The spark port is ordinarily located near an edge of the throttle plate such that when the throttle plate is nearly closed, the port is subjected to essentially atmospheric pressure but when the throttle plate is opened, the port is subjected to manifold pressure.

In any event, the port 17, whether it be located in the position of a spark port or in another position, is subjected to changes in pressure. A negative-going pressure change, that is where the vacuum at the port becomes stronger, results in flow from the dependent device through the port into the source. On the other hand, a positive-going pressure change, that is where the vacuum at the port becomes weaker, results in flow from the source through the port toward the dependent device. As a result, fuel particles as well as other substances attempt to flow toward the dependent device during a positive-going vacuum excursion.

The relay valve 30 protects the dependent device and system from contamination by fuel particles and other included substances in the following manner. During a positive-going vacuum excursion at port 17, the charge mixture attempts to flow through inlet port 49 to inlet chamber 52 raising the pressure on diaphragm 51. A pressure rise on diaphragm 51 opens the atmospheric bleed valve 44, 59 which draws ambient atmospheric air through the filter 41, chamber 46 and passage 43, providing an infusion of clean air in outlet chamber 53 and the dependent device. The infusion of fresh air in the outlet chamber, raises the pressure therein until the pressure in the inlet chamber is balanced and the diaphragm returns to its original position closing the bleed valve. Thus the pressure in the dependent device is caused to rise in accordance with a pressure rise at the port by infusion of clean air avoiding contamination of the dependent device.

When the pressure change at port 17 is negative-going, the source attempts to evacuate the dependent device and system. This results in a pressure drop in inlet chamber 52 which causes check valve 67 to open while diaphragm 51 holds the bleed valve tightly closed. As a result the clean air, previously entrapped in the outlet chamber and dependent device, is drawn through the apertures 64, 63 where it sweeps through the inlet chamber 52, inlet port 49 and spark port 17 to clear the system of any contaminants which may have entered the inlet port 49 or inlet chamber 52 during a prior positive-going pressure excursion.

Stated in another way, the portion of the system from the port 17 to the diaphragm 51 functions in the manner of a static pressure system during a positive-going pressure excursion which opposes the entry of contaminants from the vacuum source. During a negative-going pressure excursion at the port, this part of the system is no longer static but experiences flow toward the source which sweeps the passages of any contaminants which might be present.

An optional feature of construction, which is particularly desirable when used in a spark advance control system, is the inclusion of a flow restriction such as the porous plugs 66. Such a restriction, whether it be a small orifice or a porous plug provides for quick response of the dependent device to a positive-going pressure change and a slow response to a negative-going pressure change. Such fast-slow response is an important part of many emission control systems for internal combustion engines. The degree of restriction afforded by the orifice or plug is determined by the size of the orifice or by the porosity of the plug. If a vacuum signal source is permitted to deposit contaminants in the orifice or plug, the degree of restriction may change and thereby seriously affect emissions.

As shown more clearly in FIG. 3, the restriction 66 is preferably located on the clean air side of check valve 67. As a result, the check valve 67 isolates the restriction from contaminating communication with the vacuum signal source. A further advantage of the optional construction is that the restriction, is swept by clean air flowing in the same direction during each negative-going pressure excursion further comtributing to clean operation.

It is to be understood that the foregoing description relates to a preferred embodiment of the invention which may be modified for adaptation to various vacuum control systems.

We claim:

1. A vacuum relay valve having a shell-like body, a flexible diaphragm disposed therein, said diaphragm and interior portions of said body defining an inlet chamber and an outlet chamber, said inlet chamber communicating with an inlet port adapted for connection to a vacuum signal source, said outlet chamber communicating with an outlet port adapted for connection to a vacuum operated device, wherein the improvement comprises one-way check valve means arranged to control flow between said outlet chamber and said inlet chamber, said check valve means closing in response to a positive-going pressure change in said inlet chamber and opening in response to a negative-going pressure change in said inlet chamber to permit flow from said outlet chamber toward said inlet chamber, an atmospheric bleed valve operably connected to said diaphragm arranged to control flow from atmosphere toward said outlet chamber, said bleed valve closing in response to a negative-going pressure change in said inlet chamber and opening in response to a positive-going pressure change in said inlet chamber providing infusion of atmosphere into said outlet chamber in response to said positive-going pressure change in said inlet chamber, and a flow restrictor arranged in series circuit between said check valve means and said outlet chamber, said flow restrictor being protected from contaminating communication with said inlet chamber by said check valve means and being purged by flow from said outlet chamber in response to negative-going pressure change in said inlet chamber.

2. A vacuum relay valve having a shell-like body, a flexible diaphragm disposed therein, said diaphragm and interior portions of said body defining an inlet chamber and an outlet chamber, said inlet chamber communicating with an inlet port adapted for connection to a vacuum signal source, said outlet chamber communicating with an outlet port adapted for connection to a vacuum operated device, wherein the improvement comprises one-way check valve means disposed within said shell-like body including a resilient member mounted for movement with said diaphragm arranged to control flow between said outlet chamber and said inlet chamber, said check valve means closing in response to a positive-going pressure change in said inlet chamber and opening in response to a negative-going pressure change in said inlet chamber to permit flow from said outlet chamber toward said inlet chamber, and an atmospheric bleed valve operably connected to said diaphragm arranged to control flow from atmosphere toward said outlet chamber, said bleed valve closing in response to a negative-going pressure change in said inlet chamber and opening in response to a positive-going pressure change in said inlet chamber providing infusion of atmosphere into said outlet chamber in response to said positive-going pressure change in said inlet chamber.

3. A vacuum relay valve according to claim 2, including a flow restrictor mounted for movement with said diaphragm in series circuit between said resilient member and said outlet chamber.

* * * * *